US007734209B2

(12) United States Patent
Pathak et al.

(10) Patent No.: US 7,734,209 B2
(45) Date of Patent: Jun. 8, 2010

(54) IMAGING DEVICE WITH CLICK COUNT FRAGMENTATION

(75) Inventors: Rabindra Pathak, Vancouver, WA (US); Charles E. Pierson, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 171 days.

(21) Appl. No.: 12/011,102

(22) Filed: Jan. 24, 2008

(65) Prior Publication Data

US 2009/0190948 A1 Jul. 30, 2009

(51) Int. Cl.
*G03G 21/02* (2006.01)
*G03G 15/00* (2006.01)

(52) U.S. Cl. ..... 399/79; 358/1.15; 399/82

(58) Field of Classification Search ..... 399/79, 399/82, 9, 11; 705/1, 30; 358/1.15, 1.16
See application file for complete search history.

(56) References Cited

U.S. PATENT DOCUMENTS

| | | | | |
|---|---|---|---|---|
| 5,383,004 | A | 1/1995 | Miller et al. | 399/24 |
| 2003/0174356 | A1 | 9/2003 | Cherry et al. | 358/1.15 |
| 2003/0191655 | A1 | 10/2003 | Janz | 705/1 |
| 2003/0202815 | A1 * | 10/2003 | Nozawa | 399/79 |
| 2006/0078346 | A1 | 4/2006 | Lovat et al. | 399/79 |
| 2008/0107440 | A1 * | 5/2008 | Tsuzuki | 399/79 |
| 2008/0310875 | A1 * | 12/2008 | Rahman et al. | 399/79 |

* cited by examiner

*Primary Examiner*—Sophia S Chen
(74) *Attorney, Agent, or Firm*—Scot A. Reader

(57) ABSTRACT

An imaging device utilizes click count fragmentation to provide separate click counts for service and billing purposes. Click count fragmentation maintains uninterrupted service counts and derives from service counts billing counts that more accurately reflect the number of pages generated that are usable by a customer. Billing counts may be paused, resumed, reset and displayed by authorized personnel via a local or remote imaging device interface. Accesses of billing counts by authorized personnel may be recorded in an audit trail.

16 Claims, 4 Drawing Sheets

IMAGING DEVICE WITH CLICK COUNT FRAGMENTATION

BACKGROUND OF THE INVENTION

The present invention relates to imaging device click counts and, more particularly, to a method and system for click count fragmentation in which separate imaging device click counts are maintained for service and billing purposes.

Imaging devices, such as multifunction printers (MFPs), maintain click counts that track the number of pages generated by individual imaging functions, for example, the number of pages printed, scanned, copied and foxed. Known click counts are often used for both service and billing purposes. On the service side, click counts may be used to determine service times and/or warranty expiration for an imaging device. On the billing side, click counts may be used by an owner of an imaging device as a basis for billing a customer who has leased the imaging device for imaging activities, for example, printing, scanning, copying and foxing.

Use of known click counts for billing purposes has had certain shortcomings. First, known click counts cannot easily be reset. There is typically no reset option available on any local or remote imaging device interface and click counts are only reset in exceptional circumstances, such as when an MFP engine is replaced. Therefore, the owner must record the click counts at the end of each billing cycle in order to establish a baseline for determining how many pages are generated by individual imaging functions during the next billing cycle. Second, known click counts run uninterrupted and thus often go out-of-sync with the number of generated pages that are usable by the customer for business or personal use. For example, when an MFP is being serviced, service personnel may print test pages to check if the MFP is working properly. These test pages add to the printing click count even though they are not usable by the customer. Still, it is important to maintain an uninterrupted click count that includes test pages for determining service times and/or warranty expiration for the MFP.

SUMMARY OF THE INVENTION

The present invention, in a basic feature, utilizes click count fragmentation to provide separate imaging device click counts for service and billing purposes. Click count fragmentation maintains uninterrupted click counts for service purposes (hereinafter "service counts") and derives from service counts click counts for billing purposes (hereinafter "billing counts") that more accurately reflect the number of pages generated that are usable by a customer. Billing counts may be paused, resumed, reset and displayed by authorized personnel via a local or remote imaging device interface. Accesses of billing counts by authorized personnel may be recorded (for example, the authorized person's identity and actions taken) in an audit trail.

In one aspect of the invention, an imaging device comprises an interface, a memory and a processor communicatively coupled with the interface and the memory, wherein in response to a pause indication received on the interface and under control of the processor the imaging device transitions from a normal mode to a service mode and in response to a resume indication received on the interface and under control of the processor the imaging device transitions from the service mode to the normal mode, wherein while in the normal mode and under control of the processor a service count and a billing count stored in the memory are increased in response to generation of a page by an imaging function, and wherein while in the service mode and under control of the processor the service count is increased whereas the billing count is unchanged in response to generation of a page by the imaging function.

In some embodiments, the billing count is computed under control of the processor as a function of the service count.

In some embodiments, in response to a reset indication received on the interface and under control of the processor the billing count is reset to zero.

In some embodiments, while in the service mode and under control of the processor an out-of-sync count is increased in response to generation of a page by an imaging function.

In some embodiments, in response to a reset indication received on the interface and under control of the processor a last sync count is set to the service count and the out-of-sync count is set to zero.

In some embodiments, the billing count is computed under control of the processor as a function of the service count, the last sync count and the out-of-sync count.

In some embodiments, the imaging device is an MFP.

In some embodiments, the interface comprises a front panel.

In some embodiments, the interface comprises a network interface.

In some embodiments, the imaging function is selected from among a printing function, a scanning function, a copying function and a foxing function.

In some embodiments, the imaging device under control of the processor verifies that a user who initiated the pause and resume indications is authorized.

In some embodiments, the pause and resume indications are recorded in the memory in association with respective time stamps.

In some embodiments, while in the normal mode and under control of the processor a plurality of service counts and a plurality of billing counts stored in the memory are increased in response to generation of a plurality of pages by a plurality of imaging functions, and wherein while in the service mode and under control of the processor the plurality of service counts are increased whereas the plurality of billing counts are unchanged in response to generation of a plurality of pages by the plurality of imaging functions.

In some embodiments, the imaging functions are selected from among a printing function, a scanning function, a copying function and a foxing function.

In another aspect, a method for click count fragmentation on an imaging device comprises the steps of receiving a pause indication, entering a service mode in response to the pause indication wherein pages generated by an imaging function increase a service count and leave a billing count unchanged, receiving a resume indication and entering a normal mode in response to the resume indication wherein pages generated by the imaging function increase the service count and the billing count.

In some embodiments, the method further comprises the step of receiving a reset indication in response to which the billing count is reset to zero.

In some embodiments, the method further comprises the step of generating an audit trail comprising time-stamped entries indicative of the pause indication and the resume indication.

In some embodiments, the method further comprises the step of authenticating a user from whom the pause indication and resume indication are received.

In yet another aspect, a method for maintaining a billing count on an imaging device comprises the steps of transitioning the device between a first mode and a second mode in response to user inputs, generating pages by an imaging function while the device is in the first mode, updating a billing count maintained for the imaging function in response to generating pages by the imaging function while the device is in the first mode, generating pages by the imaging function while the device is in the second mode and inhibiting updating of the billing count in response to generating pages by the imaging function while the device is in the second mode.

In some embodiments, the method further comprises the steps of updating a service count maintained for the imaging function in response to generating pages by the imaging function while the device is in the first mode and updating the service count in response to generating pages by the imaging function while the device is in the second mode.

These and other aspects of the invention will be better understood by reference to the following detailed description taken in conjunction with the drawings that are briefly described below. Of course, the invention is defined by the appended claims.

DETAILED DESCRIPTION OF A PREFERRED EMBODIMENT

Figure 1:
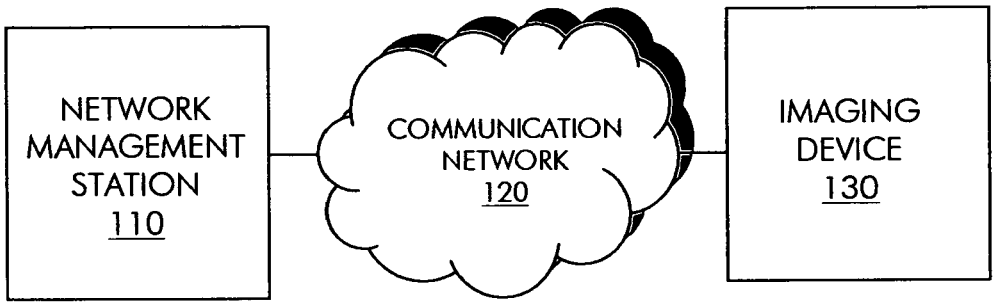
FIG. 1 shows a communication system in which the invention is operative in some embodiments.

FIG. 1 shows a communication system in which the invention is operative in some embodiments. The communication system includes a network management station 110 communicatively coupled with an imaging device 130 via a communication network 120. Network 120 may be an enterprise network or a service provider network, for example, and may include multiplexing nodes, such as routers, switches and bridges. In some embodiments, network 120 traverses the Internet. Station 110 and device 130 may have wired or wireless connectivity to network 120.

Station 110 is a data processing device, such as a desktop personal computer, laptop personal computer, workstation or personal data assistant (PDA), that is capable of remotely managing device 130. Station 110 renders the front panel of device 130 on a data output element of station 110, such as a cathode ray tube (CRT), liquid crystal display (LCD) screen or light emitting diode (LED) display screen and allows management or service personnel to remotely manage device 130 through inputs on a data input element of station 110, such as a keyboard, keypad or touch-sensitive navigation tool. Remote management is accomplished by transmitting management commands via a wired or wireless network interface of station 110, such as an Ethernet, Wide Area Network (WAN), Universal Serial Bus (USB), Bluetooth, Infrared Data Association (IrDa), wireless local area network (Wi-Fi), Worldwide Interoperability for Microwave Access (WiMAX), cellular, or Public Switched Telephone Network (PSTN) interface, and via network 120 to imaging device 130. Remote management may be facilitated by a server in network 120 that services management commands initiated by station 110 and customizes the front panel of device 130 for presentation on station 110.

Figure 2:
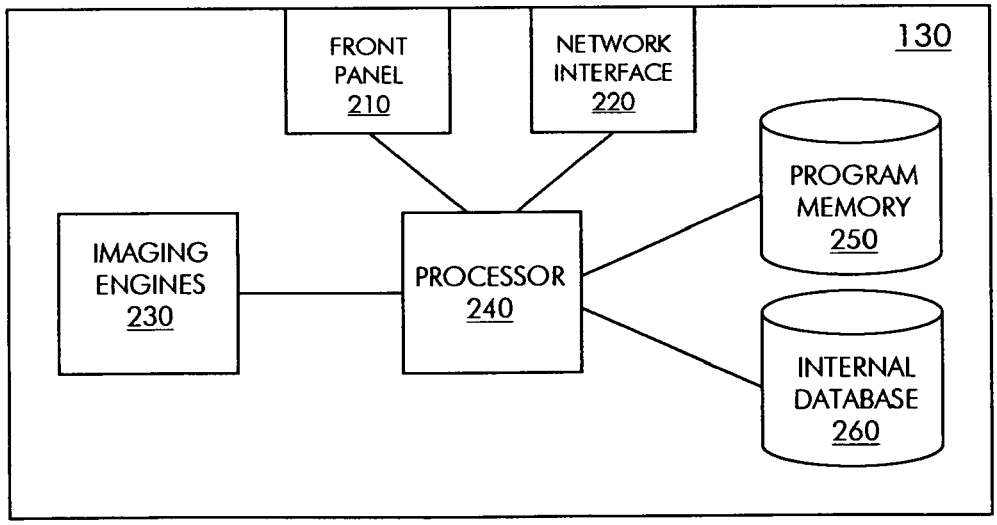
FIG. 2 shows an imaging device in which the invention is operative in some embodiments.

Turning to FIG. 2, imaging device 130 is shown in more detail. Device 130 is in the illustrated embodiment a multi-function printer (MFP) that provides multiple types of imaging, such as printing, scanning, copying and faxing. Device 130 has external interfaces including a front panel 210 and a network interface 220. Device 130 is capable of receiving via front panel 210 and network interface 220 imaging jobs and management commands.

Front panel 210 is a touch-sensitive user interface, such as an LCD or LED interface, for receiving input and displaying output from and to walk-up users and on-site management or service personnel. In some embodiments, front panel 210 has a service button or switch that can be depressed or toggled by on-site management or service personnel to transition device 130 between a normal and a service mode.

Network interface 220 is a wired or wireless interface, such as an Ethernet, USB, WAN, Bluetooth, IrDa, WiFi, WiMAX, cellular or PSTN interface that communicatively couples device 130 to network 120 for receiving input and transmitting output from and to remote users and management or service personnel (for example, management personnel using station 110). In some embodiments, interface 220 has multiple network ports that support different communication protocols.

Imaging engines 230 include, for example, print, scan, copy and fax engines, which may each include one or more integrated circuits (ICs) and mechanical sections for performing respective imaging functions. While device 130 is in the illustrated embodiment an MFP that supports printing, scanning, copying and faxing, in other embodiments an imaging device support a different set of imaging functions or single-function printing device that supports printing but not other imaging functions.

Internal to device 130, front panel 210, interface 220, engines 230, a program memory 250 and an internal database 260 are communicatively coupled with a processor 240. Processor 240 is a microprocessor that executes software stored in program memory 250 to implement imaging and management functions supported by device 130. Such software in some embodiments includes firmware.

Figure 3:
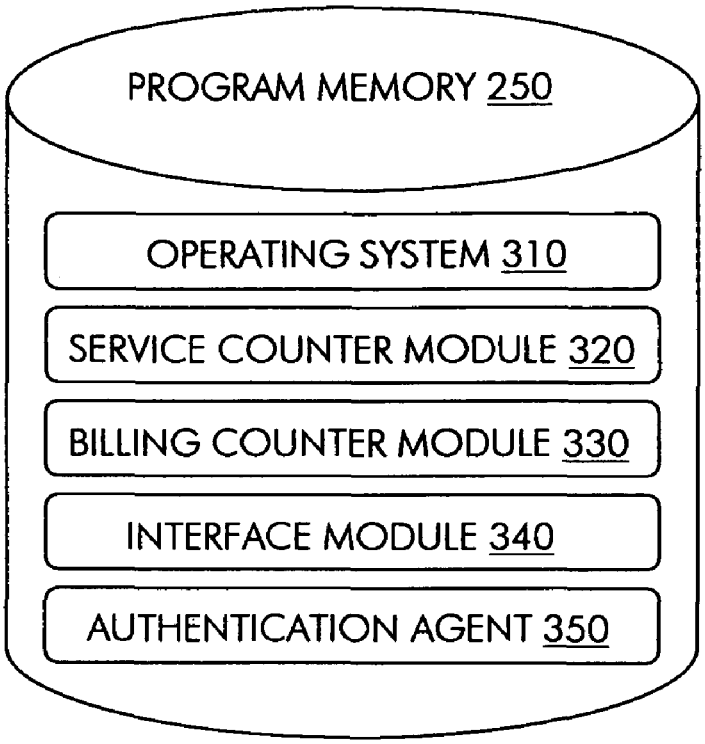
FIG. 3 shows the program memory of FIG. 2 in more detail.

FIG. 3 shows program memory 250 in greater detail. Memory 250 includes software elements 310, 320, 330, 340, 350 having instructions executable by processor 240. Operating system 310 manages interactions between various hardware and software elements of device 130. Service counter module 320 maintains uninterrupted click counts for service purposes, i.e. service counts. Billing counter module 330 derives from service counts click counts for billing purposes that more accurately reflect the number of pages generated that are usable by a customer, i.e. billing counts. Separate service and billing counts are maintained in internal database 260 for different imaging functions, for example, printing, scanning, copying, foxing. Interface module 340 interprets inputs received from management or service personnel on front panel 210 and/or network interface 220 and acts on such inputs. Such inputs include billing count pause, resume, reset and display commands. For example, a service person may initiate a pause or resume command by depressing a service button on front panel 210. Actions taken by interface module 340 in response to some inputs (e.g. pause, resume and reset commands) in some embodiments include sending inter-process communication (IPC) messages to billing counter module 330. IPC messaging may be achieved in various ways, such as sockets, message queues or web services. In some embodiments, direct method calls are used in lieu of IPC messaging. In some embodiments, interface module 340 is partitioned between a front panel interface module that interprets and acts on inputs received on front panel 210 and a network interface module that interprets and acts on inputs received on network interface 220. Authentication agent 350 authenticates management and service personnel before allowing them to manage device 130. Authentication agent 350 verifies that credentials (e.g. username and password pair) input by management or service personnel in response to an authentication challenge conform to authentication data 440 stored in internal database 260, or alternatively in an external database, and in response to such verification allows management of device 130 by such personnel.

Figure 4:
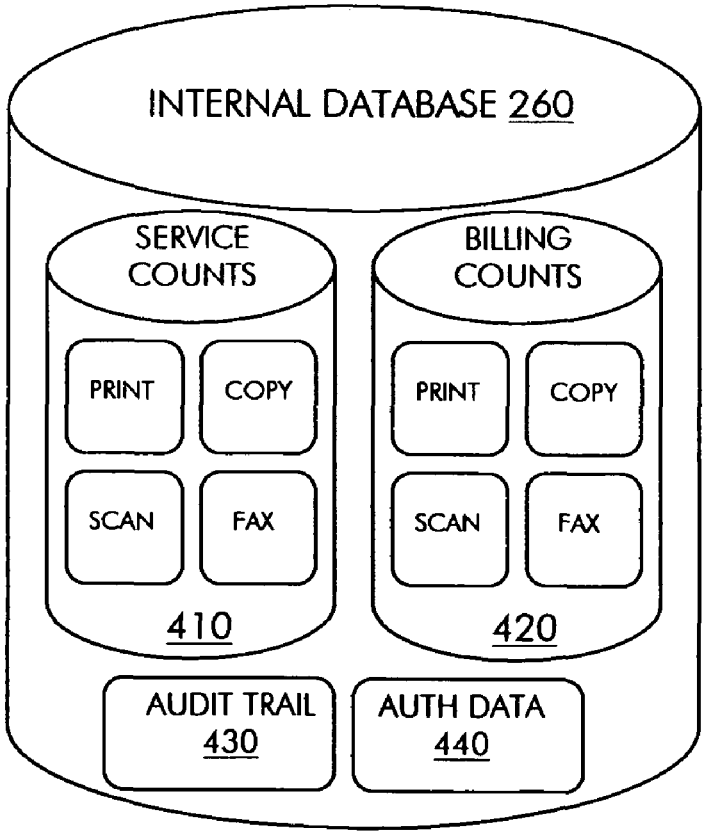
FIG. 4 shows the count database of FIG. 2 in more detail.

Turing to FIG. 4, internal database 260 is shown in greater detail. Internal database 260 includes service counts 410 that are individually maintained for different imaging functions (e.g. printing, scanning, copying, faxing) as well as billing counts 420 that are individually maintained for different imaging functions. Service counts 410 are updated by service counter module 320 in response to generation of pages by device 130 while device 130 is in either normal mode or service mode. For example, when a five-page document is generated by the printing function of device 130, service counter module 320 increments the service count maintained for printing by five. Billing counts are updated by billing counter module 330 in response to generation of pages by device 130 while device 130 is in normal mode but not while device 130 is in service mode. For example, when a five-page document is generated by the printing function of device 130 while device 130 is in normal mode, billing counter module 330 increments the billing count maintained for printing by five; however, when a five-page document is generated by the printing function of device 130 while device 130 is in service mode, billing counter module 330 does not update the billing count. Database 260 also includes an audit trail 430. Audit trail 430 is a log file in which billing counter module 330 records actions taken in response to inputs (e.g. pause, resume, reset commands), along with the identity of the management or service person who provoked the action and a time stamp indicative of the time the action was taken. Database 260 also includes authentication data 440 with credentials (e.g. username and password pairs) of personnel authorized to manage device 130. In other embodiments, authentication data may be stored in a database external to device 130.

Management of device 130, whether initiated locally via front panel 210 or remotely via station 110, includes a capability to transition device 130 between a normal mode in which a service count and a billing count stored in database 260 are both increased in response to generation of a page by an imaging function, and a service mode in which the service count is increased in response to generation of a page by an imaging function while the billing count remains unchanged. Mode transitions are realized through execution of pause and resume commands received on device 130. Management of device 130 also includes a capability to reset billing counts to zero. The reset capability is realized through execution of reset commands received on device 130.

Billing counts 420 are computationally derived from service counts 410. For each imaging function (e.g. printing, scanning, copying, faxing), billing counter module 330 maintains a billing count (B) for the imaging function according to the formula B=S−L−O, where S is the uninterrupted service count for the imaging function, L is the last sync count for the imaging function and O is the out-of-sync count for the imaging function. While in normal mode, the out-of-sync count (O) is inactive and does not increase when a page is generated by the imaging function, causing the billing count for the imaging function to increase in tandem with the service count. However, while in service mode, the out-of sync count (O) is active and does increase when a page is generated by the imaging function, causing the billing count for the imaging function to decouple from and lag the service count. Moreover, in response to a sync message prompted by a reset command, billing counter module 330 sets the last sync count (L) to the service count (S) and sets the out-of-sync count (O) to zero, which causes reset of the billing count (B) to zero. The invention thus provides a mechanism for determining billing counts 420 by leveraging existing service count functionality in imaging devices. The out-of-sync counts and last sync counts may be stored in program memory 250, internal database 260 or an external database.

Figure 5:
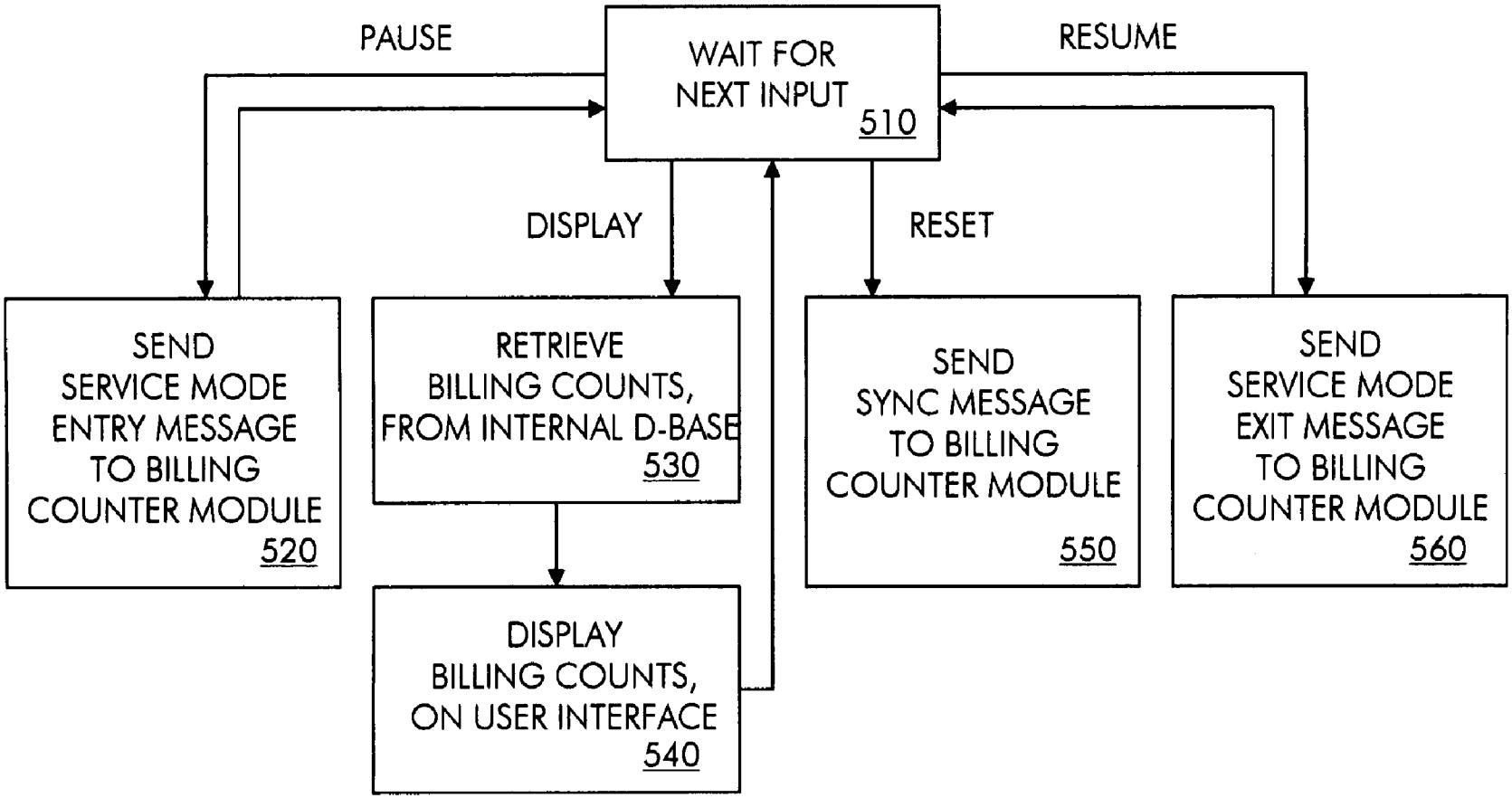
FIG. 5 shows a method performed by the interface module of FIG. 3 in some embodiments of the invention.

Turning now to FIG. 5 a method performed by interface module 340 in some embodiments of the invention is shown. The flow begins with interface module 340 in a listening state waiting for the next management-related input from either front panel 210 or network interface 220 (510). If the next input is a pause command, interface module 340 sends a service mode entry message to billing counter module 330 (520) and returns to the listening state. If the next input is a display command, interface module 340 retrieves billing counts 420 from count database 260 (530) and displays billing counts 420 on a user interface (540), such as front panel 210 or a remote data output element on network management station 110, before returning to the listening state. If the next input is a reset command, interface module 340 sends a sync message to billing counter module 330 (550) and returns to the listening state. If the next input is a resume command, interface module 340 sends a service mode exit message to billing counter module 330 (560) and returns to the listening state.

Figure 6:
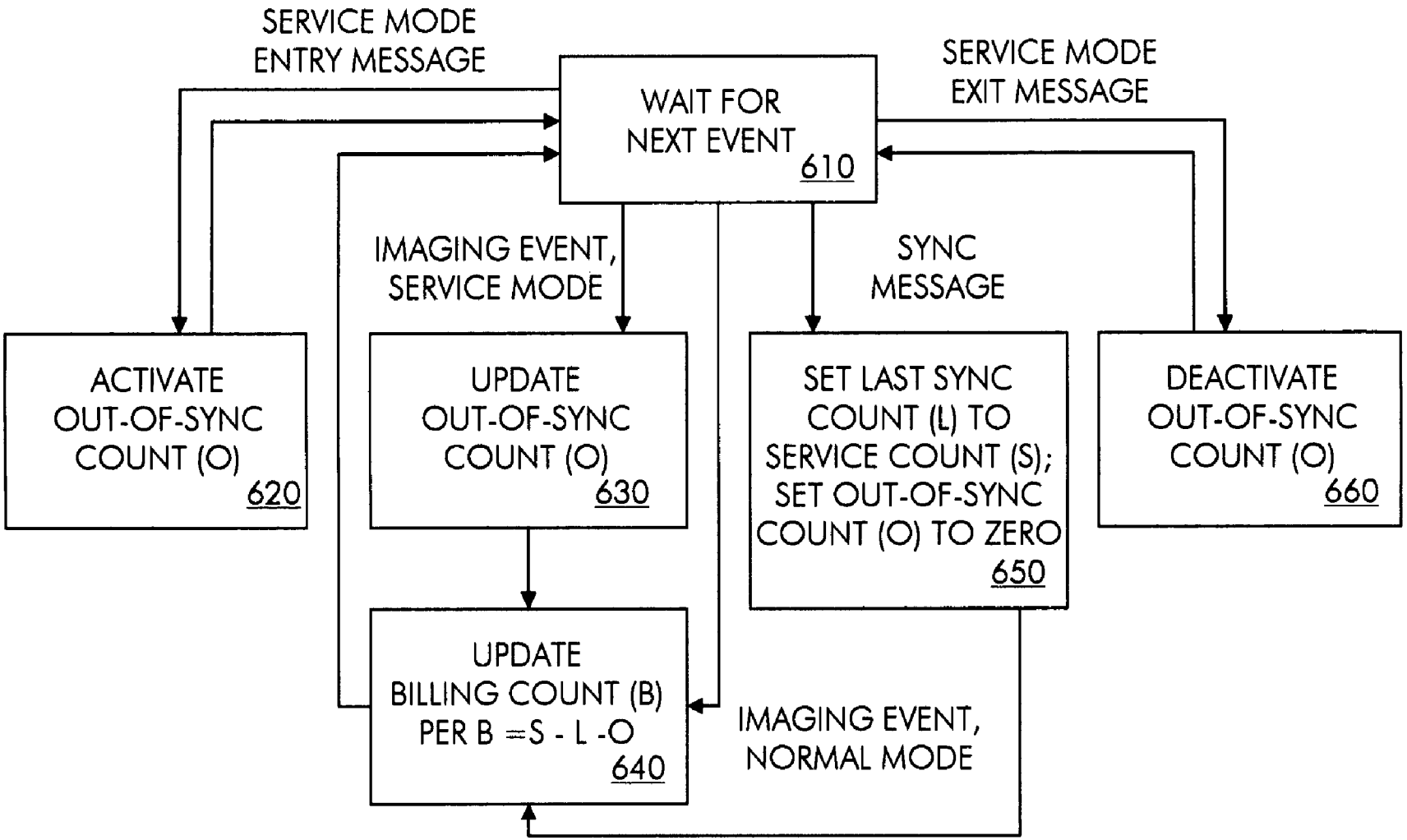
FIG. 6 shows a method performed by the billing counter module of FIG. 3 in some embodiments of the invention.

Finally, FIG. 6 shows a method performed by billing counter module 330 in some embodiments of the invention. For simplicity, the flow shows how billing counter module 330 maintains a billing count for a single imaging function (e.g. printing), although billing counter module 330 can maintain billing counts concurrently for several imaging functions (e.g. printing, scanning, copying, faxing). The flow begins with billing counter module 330 in a listening state waiting for the next IPC messaging event from interface module 340 or the next imaging event (610). If the next event is a service mode entry message received from interface module 340, billing counter module 330 causes device 130 to enter service mode, which involves activating out-of-sync count (O) (620), and returns to the listening state. If the next event is an imaging event (e.g. generation of a printed page) and device 130 is in service mode, billing counter module 330 updates the out-of-sync count (O) (630) and then computes the billing count (B) according to the formula B=S−L−O, where L is the last sync count and S is the service count (kept current by service counter module 320) (640), and returns to the listening state. If the next event is an imaging event (e.g. generation of a printed page) and device 130 is in normal mode, billing counter module 330 computes the billing count (B) without updating the out-of-sync count (O) (640), and returns to the listening state. If the next event is a sync message received from interface module 340, billing counter module 330 causes device 130 to reset the billing count (B), which involves setting the last sync count (L) to the service count (S) and setting the out-of-sync count (O) to zero (650), and returns to the listening state. Finally, if the next event is a service mode exit message received from interface module 340, billing counter module 330 causes device 130 to enter normal mode, which involves deactivating out-of-sync count (O) (660), and returns to the listening state.

It will be appreciated by those of ordinary skill in the art that the invention can be embodied in other specific forms without departing from the spirit or essential character hereof. The present description is therefore considered in all respects to be illustrative and not restrictive. The scope of the invention is indicated by the appended claims, and all changes that come with in the meaning and range of equivalents thereof are intended to be embraced therein.

What is claimed is:

1. An imaging device, comprising:

an interface;

a memory; and a processor communicatively coupled with the interface and the memory, wherein in response to a pause indication received on the interface and under control of the processor the imaging device transitions from a normal mode to a service mode and in response to a resume indication received on the interface and under control of the processor the imaging device transitions from the service mode to the normal mode, wherein while in the normal mode and under control of the processor a service count and a billing count stored in the memory are increased in response to generation of a page by an imaging function, wherein while in the service mode and under control of the processor the service count is increased whereas the billing count is unchanged in response to generation of a page by the imaging function, wherein while in the service mode and under control of the processor an out-of-sync count is increased in response to generation of a page by an imaging function, and wherein in response to a reset indication received on the interface and under control of the processor a last sync count is set to the service count and the out-of-sync count is set to zero.

2. The device of claim 1, wherein the billing count is computed under control of the processor as a function of the service count.

3. The device of claim 1, wherein in response to the reset indication and under control of the processor the billing count is reset to zero.

4. The device of claim 1, wherein the billing count is computed under control of the processor as a function of the service count, the last sync count and the out-of-sync count.

5. The device of claim 1, wherein the device is a multifunction printer (MFP).

6. The device of claim 1, wherein the interface comprises a front panel.

7. The device of claim 1, wherein the interface comprises a network interface.

8. The device of claim 1, wherein the imaging function is selected from among a printing function, a scanning function, a copying function and a faxing function.

9. The device of claim 1, wherein the device under control of the processor verifies that a user who initiated the pause and resume indications is authorized.

10. The device of claim 1, wherein the pause and resume indications are recorded in the memory in association with respective time stamps.

11. The device of claim 1, wherein while in the normal mode and under control of the processor a plurality of service counts and a plurality of billing counts stored in the memory are increased in response to generation of a plurality of pages by a plurality of imaging functions, and wherein while in the service mode and under control of the processor the plurality of service counts are increased whereas the plurality of billing counts are unchanged in response to generation of a plurality of pages by the plurality of imaging functions.

12. The device of claim 11, wherein the imaging functions are selected from among a printing function, a scanning function, a copying function and a faxing function.

13. A method for click count fragmentation on an imaging device, comprising the steps of:

receiving a pause indication on the imaging device;

entering a service mode by the imaging device in response to the pause indication wherein pages generated by an imaging function increase a service count and an out-of-sync count and leave a billing count unchanged;

receiving a resume indication on the imaging device;

entering a normal mode by the imaging device in response to the resume indication wherein pages generated by the imaging function increase the service count and the billing count;

receiving a reset indication on the imaging device; and setting a last sync count to the service count and the out-of-sync count to zero by the imaging device in response to the reset indication.

14. The method of claim 13, further comprising the step of:

resetting the billing count to zero by the imaging device in response to the reset indication.

15. The method of claim 13, further comprising the step of generating an audit trail comprising time-stamped entries indicative of the pause indication and the resume indication.

16. The method of claim 13, further comprising the step of authenticating a user from whom the pause indication and resume indication are received.

* * * * *